United States Patent [19]

Agnew et al.

[11] Patent Number: 4,986,031

[45] Date of Patent: Jan. 22, 1991

[54] GATE ASSEMBLY

[75] Inventors: Colvin H. Agnew, Billings, Mont.; Weldon O. Wade, Alamogordo; Stuart H. Agnew, Albuquerque, both of N. Mex.

[73] Assignee: W & A Enterprises, Alamogordo, N. Mex.

[21] Appl. No.: 1,847

[22] Filed: Jan. 9, 1987

[51] Int. Cl.[5] ..... E05D 7/00

[52] U.S. Cl. ..... 49/385; 49/386; 49/340

[58] Field of Search ..... 49/334, 339, 340, 385, 49/386

[56] References Cited

U.S. PATENT DOCUMENTS

| | | | |
|---|---|---|---|
| 800,078 | 9/1905 | Connolly . | |
| 1,224,353 | 5/1917 | Bacho . | |
| 1,611,367 | 12/1926 | Pickett . | |
| 3,839,826 | 10/1974 | Ries | 49/385 |
| 4,270,312 | 6/1981 | Courtis et al. | 49/385 |
| 4,381,626 | 5/1983 | Courtis et al. | 49/385 |
| 4,470,221 | 9/1984 | Courtis | 49/385 |
| 4,481,737 | 11/1984 | Rebhan et al. | 49/385 |

*Primary Examiner*—Kenneth J. Dorner
*Assistant Examiner*—Gerald A. Anderson
*Attorney, Agent, or Firm*—Lane, Aitken & McCann

[57] ABSTRACT

A gate assembly for a motor driven vertically pivoting gate includes a support frame and coil springs attached between the gate and the support frame to bias the gate toward a vertical, open position and thereby assist the drive motor. A member secured to the support frame deflects the springs when the gate is in the open position, thereby placing the springs in tension so that the springs also assist the drive motor in starting the gate to move from its open position toward its closed position. The member also engages the gate when it is in its open position and supports the gate in a precisely vertical orientation.

11 Claims, 2 Drawing Sheets

GATE ASSEMBLY

BACKGROUND OF THE INVENTION

This invention relates to a power driven gate assembly for a vertically pivoting gate.

Generally, openings in enclosed areas have gates for controlling ingress and egress via walkways and roadways. The most common gate style is the swinging gate, but, although swinging gates are satisfactory for walkways, their use becomes more cumbersome as they increase in size, such as for roadways. Conventional roadway gates have a number of drawbacks. For example, the weight of roadway gates presents a problem in the provision of adequate hinges and may make the gate difficult to operate. In an attempt to solve these problems, pairs of gates meeting at the center sometimes are utilized.

Another problem with roadway gates is the need for getting out of a vehicle to open the gate, driving the vehicle through, and getting out of the vehicle again to close the gate. For this reason, remotely operated power driven gates are desirable, but power mechanisms to operate swinging gates are complicated and expensive. As a result, other proposals for power operated roadway gates have been made, including gate assemblies having overhead frameworks into which the gates are raised. Such gate assemblies of necessity have limited overhead clearance and are unsightly because of the overhead structural elements.

Many of the drawbacks of the gate assemblies just discussed are overcome by power operated gates which pivot so that they stand vertically on end when opened. One such gate, which is the subject of U.S. Pat. No. 3,839,826, utilizes a combination of a tension spring and a torsion spring to assist the power drive mechanism, whereby the tension spring urges the gate from the closed position toward the open position and the torsion spring acts in the opposite direction.

Although this vertically pivoting power driven gate construction offers advantages over swinging gates, particularly in snowy climates, it has certain shortcomings. The drive motor has to be of considerable size because of its location adjacent the pivot point of the gate. Also, the use of the combination of the torsion spring and the tension spring makes the design somewhat complicated and increases its cost. These shortcomings were avoided in the gate assembly disclosed in U.S. Pat. No. 4,470,221, which can be operated with a conventional power source, such as a common garage door opening unit, and can be operated manually if desired using only a minimum of effort. Furthermore, the gate assembly of U.S. Pat. No. 4,470,221 employs an arcuate fulcrum for each tension spring in order to tension the springs as the gate approaches its open position and thereby eliminate the need for a separate spring to perform that function. However, this arrangement tends to place a large torque on the ends of the springs. In addition, known vertically pivoting gates rely on switches in the drive motors to stop the gate in its closed and open positions. These switches, which are usually in the form of knurled knobs, may and do travel from their initial settings, thereby allowing the barrier to open or close beyond its intended limit. As a result, the movement of the gate can be limited by structural members of the gate assembly before the switches shut off current to the motor. Therefore, the motors can overload and burn out.

When the gate pivots past vertical, a component of the weight of the gate acts against the start of the pivoting movement of the gate back toward the closed position and thereby increases the load on the motor. Since the issuance of U.S. Pat. No. 4,470,221, there has been an increased demand for gate assemblies to close even wider openings in enclosures, thereby calling for even longer and heavier gates or barriers. Such great lengths tend to place an excessive load on the pivot shafts and brackets of vertical pivoting gate assemblies and to render the gates unstable as they move between their horizontal, closed positions and their vertical, open positions. The increased weight of the longer gates renders the spring arrangements of the previous gate assemblies marginal or totally inadequate in assisting the motor drives.

SUMMARY OF THE INVENTION

By the present invention, vertically pivoting gates of great length can operate stably and reliably over an extended gate lifetime. More specifically, a spring mounting arrangement allows the tension of the motor-assisting springs to be adjusted more easily and for additional springs to be mounted for greater motor assistance. Furthermore, a stop member provided in a gate support frame not only supports the gate at precisely 90° to the horizontal when the gate is in the open position, but also places all of the springs in tension as the gate approaches its open position in order to help the motor start moving the gate when closing of the gate is desired. Moreover, the stop member tensions the springs without the need for arcuate fulcrums and avoids the large torsional forces which are induced in the ends of the springs in arrangements using arcuate fulcrums. In addition, stabilizer members extend laterally from the support frame, and ball bearings in pillow blocks are provided for receiving the pivot shaft to accommodate the greater bearing forces generated by longer and heavier gates.

These and other benefits and advantages of the gate assembly of the present invention will be apparent from the following description and the accompanying drawings.

DETAILED DESCRIPTION OF THE PREFERRED EMBODIMENT

Figure 1:
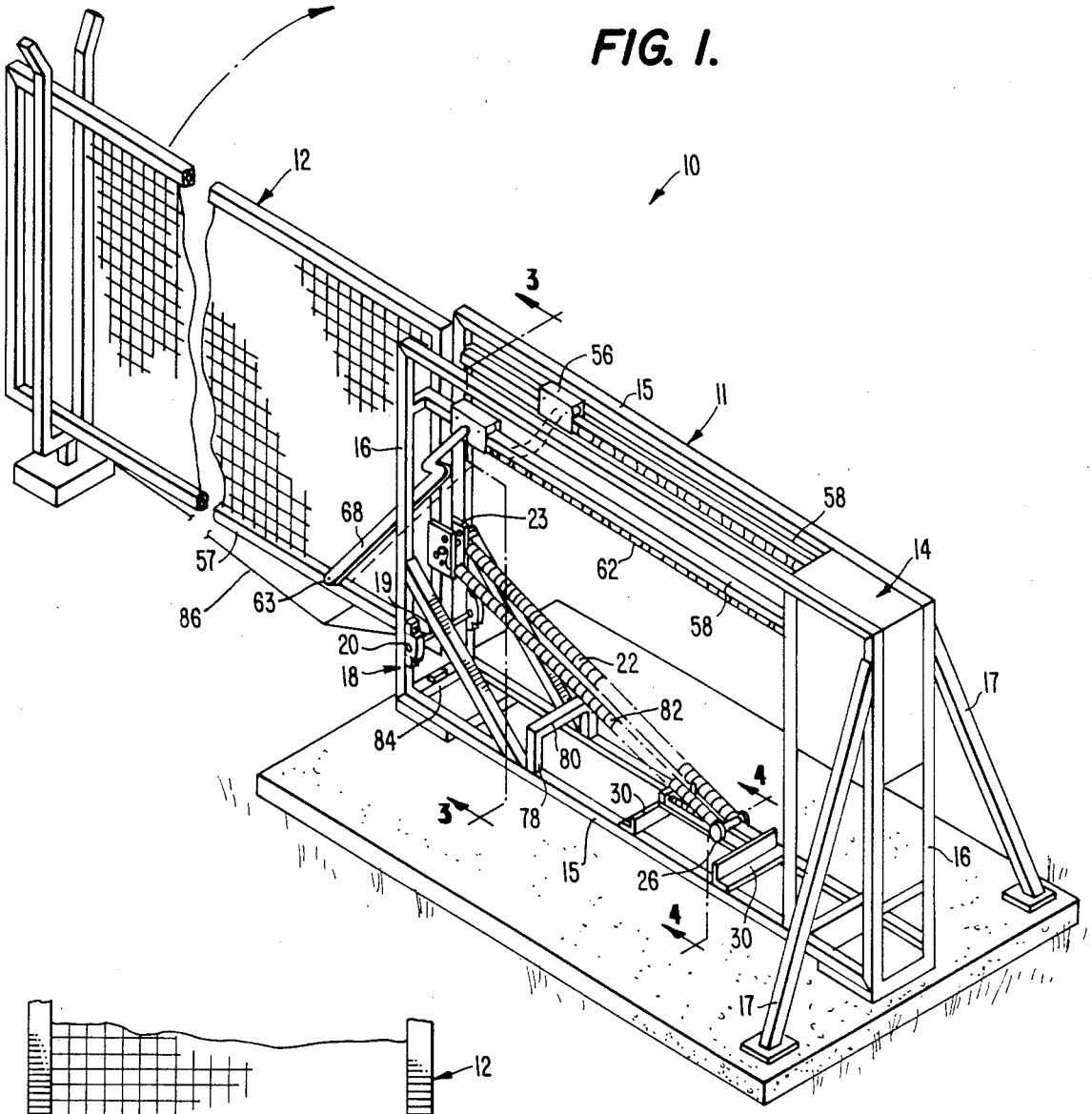
FIG. 1 is a view in perspective of one form of the gate assembly of the invention in a closed position.
Figure 2:
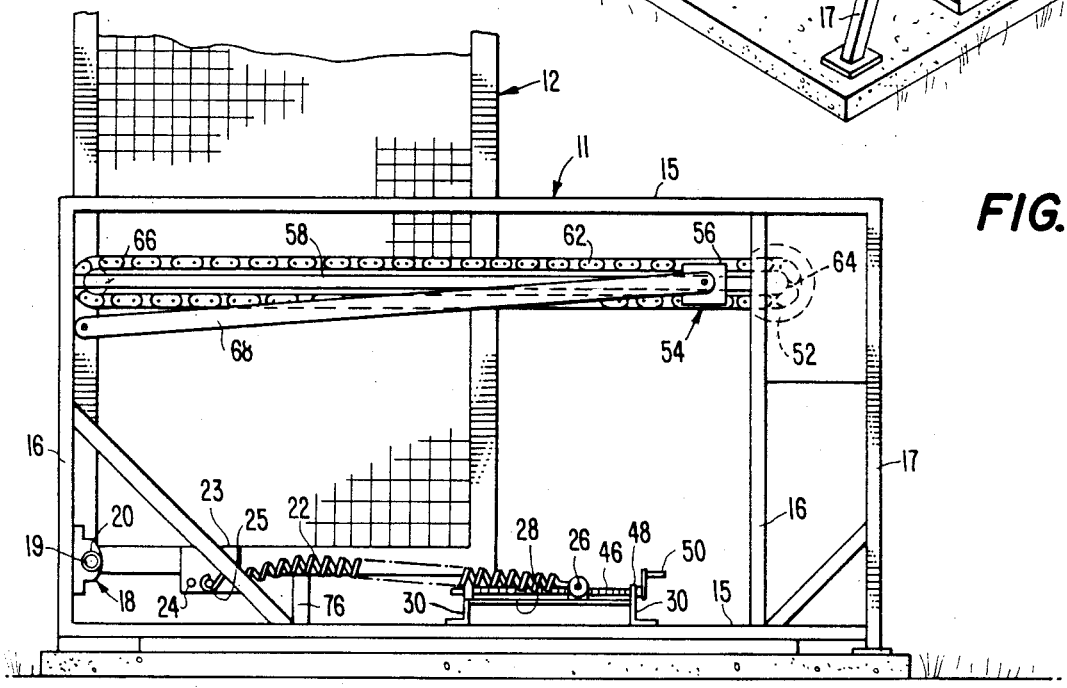
FIG. 2 is an enlarged fragmentary side view of the gate assembly shown in FIG. 1 in an open position.

As is best shown in FIGS. 1 and 2, one form of the gate assembly of the invention, which is designated generally by the reference numeral 10, includes a support frame 11 and a gate 12 carried by the support. The gate 12 is movable with respect to the support frame 11. A gate activating portion is mounted on generally horizontal members 15 and generally vertical members 16 of the support frame 11. Advantageously, the generally horizontal and vertical frame members 15 and 16 are disposed on opposite sides of the plane of the gate. The gate 12 has one end disposed adjacent to the support frame 11 with the gate 12 extending outwardly therefrom. Brace members 17 preferably extend laterally at an angle from an upper portion of the support frame to a plate embedded in concrete base to provide the gate assembly 10 with lateral stability. Although the brace members 17 are shown at only one end of the support frame 11 for clarity of illustration, it is understood that they normally will also be provided at the opposite end. The lower part of the gate end adjacent to the support frame 11 is connected thereto through a pivot connection 18.

The pivot connection 18 includes a rotatable shaft 19 received in rolling-element bearings 20, such as sealed ball bearings of the pillow block type, which are well suited for attachment to the vertical frame members 16. Between the bearings 20 the rotatable shaft 19 is connected to the gate 12 by, for example, plates welded to a member of the gate 12 adjacent to the pivot axis, the plates having apertures or other configuration to receive the rotatable shaft 19 and to fix the shaft to the gate.

A biasing device, that is, a generally linear tension device such as at least one coil spring 22, and preferably two or more coil springs 22 spaced from each other a sufficient distance that the gate 12 may pass therebetween in its movement from a closed position to an open position, assists a drive mechanism, to be described hereinafter, to move the gate 12. The upper end of each spring 22 is attached to the end of the gate 12 adjacent to the pivot axis, that is, the end of the gate 12 closest to the vertical frame members 16 of the support frame 11. The opposite or lower end of each spring 22 is affixed to an adjustable slide connector to be described hereinafter. Preferably, the ends of the springs 22 include separate hooks which are secured to the last one or several turns of the spring and which reduce the bending forces which are present in hook portions which are unitary with the springs.

Figure 3:
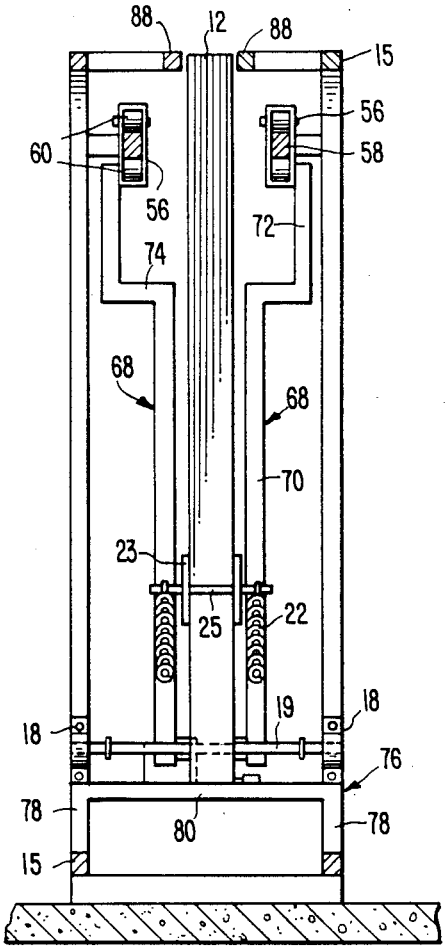
FIG. 3 is a sectional view of the gate assembly shown in FIG. 1 taken along line 3—3 thereof.

For attaching the upper ends of the springs 22, as can be seen from FIGS. 1–3, a pair of plates 23 is secured to the gate 12, extending toward the support frame 11. A plurality of apertures 24 are defined in each plate 23, each aperture 24 being in alignment with a corresponding aperture 24 in the other plate 23 so that a pin 25 can be received in any or all of the pairs of apertures to anchor the springs 22. The hooks on the ends of the springs 22 secure the springs to the pin 25, and transverse bores near the ends of the pin 25 receive cotter pins to retain the hooks on the pin 25, in a manner similar to that to be described for securing the lower ends of the springs 22. Pins of varying length can be used, and longer pins can accommodate two pairs of springs 22, in which case two transverse bores are provided in the portions of the pin extending laterally beyond each plate 23.

Figure 4:
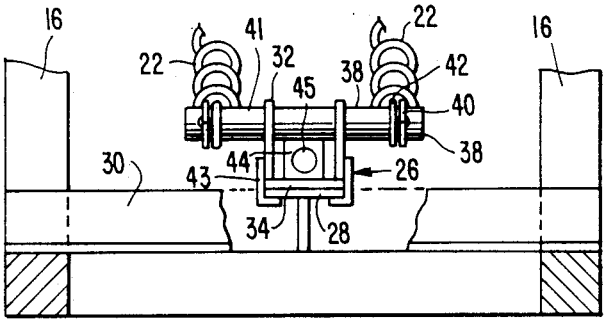
FIG. 4 is a partial sectional view of the gate assembly taken along line 4—4 of FIG. 1.
Figure 5:
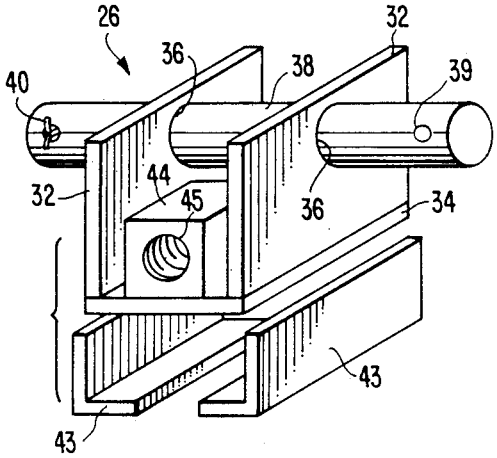
FIG. 5 is an enlarged perspective view of an adjustable slide connector used in connection with tensioning springs in the gate assembly of FIG. 1.

The adjustable slide connector 26 is mounted on a slide rail 28 extending between two cross members 30 secured between the lower horizontal members 15 of the frame 11. As can best be seen from FIGS. 4 and 5, a pair of upstanding plates 32 on the slide connector 26 extend up from a base plate 34 resting on the slide rail 28 and define aligned openings 36 for accepting an anchoring pin 38 having projecting ends to which the lower ends of the springs 22 are attached. Transverse bores 39 are defined near the ends of anchoring pin 38 to receive cotter pins 40 for retaining the hooks 41 of the springs 22. Washers 42 are normally employed in connection with the cotter pins 40.

A pair of angle members 43 secured to the upstanding plates 32 extend under the slide rail 28 to capture the slide rail between the base plate 34 and the angle members 43. An element 44 having a threaded bore 45 is affixed to the base plate 34 to receive a mating screw element 46, which is journalled in journal members 48 mounted on the cross members 30. By rotation of the screw element 46, the slide connector 26 is made to move along the slide rail 38 and, thereby, adjust the tension in the springs 22. A crank 50, which may be detachable, is provided to turn the screw element 46 by connection to, for example, a hexagonal head on an end of the screw element 46 projecting past one of the journal members 48. The adjustable slide connector 26 changes the initial length and thereby the tension in the springs 22.

The gate activating portion 14 provides movement of the gate 12 from the down or closed position, as shown in FIG. 1, to the open or raised position, as shown in FIG. 2, and back. The gate activating portion 14 advantageously is mounted on, and preferably within, the support frame 11. The gate activating portion 14 includes a power source which advantageously includes an electric motor 52 and a drive mechanism 54 operatively connected to the electric motor. The drive mechanism 54 includes a pair of transversely spaced roller assemblies 56 each carried on a horizontal rail member of the support frame 11 for movement in a substantially horizontal plane, as can be seen from FIG. 3. The rail members 58 extend from adjacent the electric motor 52 to the opposite end of the support frame in an upper portion thereof. The rail members 58 are disposed substantially parallel to the horizontal frame members 15 and are sufficiently spaced from each other to accommodate the gate 12 therebetween.

Each of the roller assemblies 56 includes a plurality of rollers 60 in contact with the rail members 58, preferably with some of the rollers 60 engaging the top of their rail member 58, and some of the rollers 60 engaging the bottom of the rail member. A continuous flexible drive loop 62, such as a drive chain, is connected to each roller assembly 56 and is adjacent the ends of each rail member 58 on sprockets 64 and 66. The sprockets 64 are operatively connected to the electric motor 52 to be rotated thereby in both directions. Arm members 68 extend from the roller assemblies 56 to opposite sides of the gate 12. Each arm member 68 has one end 55 pivotally connected to the roller assembly 56 disposed on the same side of the gate 12 as the arm member.

The opposite end of each arm member 68 is pivotally connected to the gate 12 adjacent the lower edge 57 of the gate (FIG. 1). The point of pivotal connection is spaced from the rotatable shaft 19, which defines the pivot axis of the gate 12. The pivotal connections of the lower ends of the arm members 68 to the gate 12 advantageously are achieved through a common pin 63 extending through the arm ends and the gate 12. Each of the arm members 68 preferably includes a main longitudinal section 70 that extends closely adjacent the gate 12 and a secondary longitudinal section 72 adjacent the respective roller assembly 56. The secondary longitudinal section 72 is offset from the main longitudinal section 70 and connected therewith by a short transverse section 74.

An inverted U-shaped stop member 76 is secured across the lower horizontal members 15 of the support 11 to prevent the gate 12 from pivoting beyond a 90° angle with respect to the horizontal when the gate moves into its open position, as shown in FIG. 2. Although a control system for the electric motor 52 includes switches for stopping the motor when the gate 12 is opened and closed, such a system is not precise enough to prevent the gate from going past the vertical when it moves into its open position. The inverted U-shaped stop member 76 includes a pair of upright members 78, each secured to one of the lower horizontal members 15 of the support frame 11 horizontally between the rotatable shaft 19 and the adjustable slide connector 26. A cross member 80 is affixed to the top of the upright members 78 so that it engages the end of the gate 12 adjacent the rotatable shaft 19 when the gate attains a precisely vertical position. Thus, the cross member 80 is positioned such that its upper surface is at a level above the bottom horizontal frame members 15 equal to the level of the pivot axis defined by the rotatable shaft 19 minus the distance from the pivot axis to the adjacent end of the gate 12. A limit switch 82 is mounted, for example, on the cross member 80, to shut off power to the electric motor 52 when the gate 12 reaches its vertical position. Another limit switch 84 can be mounted, for example, on a cross member of the support frame 11 near the pivot axis, to shut off power to the electric motor 52 when the gate 12 reaches its horizontal position. The height of the cross member 80 above the bottom horizontal frame members 15 is greater than the corresponding height of a straight line between the pin 25 on the gate 12 and the anchoring pin 38 on the adjustable slide member 26 when the gate is in the open position, so that the cross member 80 of the stop member 76 deflects the spring 22 upward and thereby induces tension in the spring 22. As a result, the spring 22 assists the electric motor 52 in beginning the movement of the gate 12 from its vertical, open position to its horizontal, closed position.

In the operation and use of the gate assembly 10 of the present invention as shown in the drawings, the gate activating portion 14 may be actuated by, for example, a radio transmitter and receiver (not shown) of a garage door opener. This starts the operation of the electric motor 52 and the rotation of sprockets 54 and, consequently, movement of the drive loops 62 to advance the roller assemblies 56 attached thereto. Movement of the roller assemblies 56 cause the arm members 68 pivotally connected thereto to be drawn into the support frame 11. Since the arm members 53 and 54 are pivotally connected at their lower ends to the lower edge of the gate 12, the end of the gate adjacent the support frame 11 is rotated about the rotatable shaft 19. As one end of the gate 12 moves pivotally into the support frame 11, the ends of the springs 22 affixed to the gate 12 move below the level of the cross members 80, causing the cross member to deflect the springs 22 upward and to induce tension in them. The upward movement of the gate 12 continues until the gate has pivoted to a vertical position at precisely a right angle to its original horizontal position, at which point the end of the gate 12 adjacent to the rotatable shaft 19 contacts the cross member 80 and is supported thereby.

To close the gate 12, the radio transmitter may be actuated again to reverse the electric motor 52 and the direction of travel of the drive loops 62, the roller assemblies 56 and the arm members 68. The tension in the springs 22 helps start the gate 12 moving toward its closed position and reduces the load on the electric motor 52.

Operation of the gate assembly 10 of the invention also can be effected through the use of electrical switches (not shown) located adjacent the gate assembly rather than with a radio transmitter. In addition, if there should be a power failure, the gate assembly can be operated manually. Manual operation may be achieved conveniently by releasing a clutch (not shown) on the electric motor 52 or by disconnecting the arm members 68 from the gate 12 and/or from roller assemblies 56 and simply lifting the free end of the gate 12. Since the spring members 22 in combination with the stop member 76 provide an effective counterbalancing of the movement of the gate, the gate can be moved manually in either direction with a minimum of effort.

It will be apparent that various modifications within the scope of the invention can be made in the particular embodiment of the gate assembly described in detail above and shown in the drawings. For example, anti-sway cables 86 (FIG. 1) can be secured across the gate 12 to stiffen it and provide it with greater stability, and spreaders can be positioned between the gate 12 and the cables 86 intermediate the ends of the cables. The anti-sway cables 86 are attached at one end to the rotatable shaft 19 and at the other end to the end of the gate 12 remote from the rotatable shaft, the anti-sway cables 86 passing over spreaders 87 projecting from the gate 12 adjacent its lower edge 57. As another example, guide members such as shims 88 (FIG. 3) can be secured to the upper horizontal frame embers 15 of the support frame 11 to guide the gate 12 as it moves between its open and closed positions. In addition, the size, configuration and arrangement of the components can be changed to meet specific requirements. Also, a variety of structural materials may be utilized in the fabrication of the gate assembly as desired. Therefore, the scope of the invention is to be limited only by the following claims.

We claim:

1. A gate assembly comprising:

a gate;

a support for said gate, said gate being movable relative to said support between a closed position, in which said gate is generally horizontal, and an open position, in which said gate is generally vertical;

means for biasing said gate toward the open position, said biasing means exerting a force on said gate insufficient to independently move said gate to the open position; and means for inducing a return bias in said biasing means when said gate is near the open position, said return bias inducing means also comprising means for contacting said gate to support said gate in a precisely vertical orientation when said gate is in the open position.

2. The gate assembly of claim 1, wherein said biasing means comprises at least one generally linear tension spring having a first end attached to said gate and a second end attached to said support.

3. The gate assembly of claim 2, wherein said generally linear tension spring is a coil spring.

4. The gate assembly of claim 2, further comprising means or adjusting the tension in said generally linear tension spring, wherein said tension adjusting means comprises a connector movably secured to said support, and said second end of said generally linear tension spring is attached to said connector.

5. The gate assembly of claim 2, wherein said return bias inducing means comprises a member deflecting said generally linear tension spring when said gate is in the open position.

6. The gate assembly of claim 5, wherein said member is secured to said support.

7. The gate assembly of claim 5, wherein said member engages said gate when said gate is in a precisely vertical position.

8. The gate assembly of claim 5, wherein said biasing means comprises a plurality of generally linear tension springs, and said member deflects said springs when said gate is in the open position.

9. The gate assembly of claim 5, wherein said member deflecting said generally linear tension spring extends across a plane defined by the movement of said gate between its open and closed positions.

10. The gate assembly of claim 1, further comprising rolling-element bearings secured to said support and a rotatable shaft connected to said gate and received in said bearings.

11. The gate assembly of claim 1, further comprising means for driving said gate between said open position and said closed position.

* * * * *

UNITED STATES PATENT AND TRADEMARK OFFICE

CERTIFICATE OF CORRECTION

PATENT NO. : 4,986,031

DATED : January 22, 1991

INVENTOR(S) : Colvin H. Agnew et al.

It is certified that error appears in the above-identified patent and that said Letters Patent is hereby corrected as shown below:

COLUMN 6:

Claim 4, line 2, "or" should be --for--.

Signed and Sealed this

Twenty-fifth Day of August, 1992

*Attest:*

DOUGLAS B. COMER

*Attesting Officer*

*Acting Commissioner of Patents and Trademarks*